US006712500B2

(12) United States Patent
Tu et al.

(10) Patent No.: US 6,712,500 B2
(45) Date of Patent: Mar. 30, 2004

(54) ESCAPEMENT DEVICE FOR TIMEPIECE

(75) Inventors: Xuan-Mai Tu, Ecublens (CH); Michel Schwab, Bienne (CH)

(73) Assignee: Detra SA, Bienne (CH)

( * ) Notice: Subject to any disclaimer, the term of this patent is extended or adjusted under 35 U.S.C. 154(b) by 0 days.

(21) Appl. No.: 10/257,100

(22) PCT Filed: Mar. 7, 2001

(86) PCT No.: PCT/CH01/00148

§ 371 (c)(1),
(2), (4) Date: Oct. 8, 2002

(87) PCT Pub. No.: WO01/77759

PCT Pub. Date: Oct. 18, 2001

(65) Prior Publication Data

US 2003/0090962 A1 May 15, 2003

(30) Foreign Application Priority Data

Apr. 11, 2000 (CH) ..... 727/2000
Jul. 6, 2000 (CH) ..... 1332/2000

(51) Int. Cl.[7] ..... G04B 15/00
(52) U.S. Cl. ..... 368/126; 368/127; 368/160

(58) Field of Search ..... 368/124–133, 368/160–164

(56) References Cited

U.S. PATENT DOCUMENTS 3,660,737 A * 5/1972 Sakai et al. ..... 318/138
3,892,066 A * 7/1975 Watkins ..... 368/159
4,007,582 A * 2/1977 Dugan et al. ..... 368/126

FOREIGN PATENT DOCUMENTS

CH 463 400 1/1963
FR 1 522 609 8/1968

* cited by examiner

*Primary Examiner*—Vit W. Miska
(74) *Attorney, Agent, or Firm*—Pearne & Gordon LLP

(57) ABSTRACT

The invention concerns an escapement device comprising a power source capable of delivering a variable torque based on the angle of rotation of a pinion fixed to said power source, said variable torque having at least a stable position and an unstable position. The device further comprises locking means capable of locking power transmission to an oscillator in a stable point of equilibrium and unlocking means capable of unlocking power transmission to said oscillator between a stable point of equilibrium and an unstable point of equilibrium.

19 Claims, 8 Drawing Sheets

ESCAPEMENT DEVICE FOR TIMEPIECE

BACKGROUND OF THE INVENTION

The present invention concerns an escapement device for a timepiece.

For a timepiece and particularly a mechanical timepiece, the escapement device constitutes a master part which, on one hand, has to deliver the power required to maintain the oscillatory motion of the mechanical oscillator, balance wheel, and hairspring, and on the other hand, must transmit the oscillation frequency of the oscillator to the gears driving the time display.

PRIOR ART

Thus, the prior art in devices of this type is considerable. The handbooks published under the titles "Echappements et moteurs pas à pas" (Escapements and step motors) and "Théorie d'horlogerie" (Watch-making theory), ISBN 2-940025-10-X, both by the Swiss Federation of Technical Colleges, describe numerous escapement devices, and in particular those called "anchor", "detent", and "Graham" escapements.

The major drawbacks of these known devices are:

- a poor efficiency; the best efficiency that can be obtained with these known devices is of the order of 30 to 40%, which limits the running time of the watch,
- a limited working frequency; the efficiency of the known escapements drops off considerably when the oscillator frequency is raised to a perceptible degree, and moreover, anchor escapements develop a wear problem of the escapement wheel when the frequency is high,
- difficulties of manufacture; for efficiencies of the order of 30 to 40%, the anchor escapements require a number of highly precise trimming operations.

SUMMARY OF THE INVENTION

It is a goal of the present invention, therefore, to propose an escapement device for a timepiece that is improved over known devices, that is, their known drawbacks have been reduced at least in part.

It is another goal of the invention to propose an escapement device that is insensitive to external impacts, and will not exhibit galloping effects.

It is yet another goal of the invention to propose a timepiece equipped with such an escapement device.

These goals are attained by an escapement device for timepieces as described in claim 1, as well as by a timepiece as described in claim 19. Particular embodiments or variants are described in the dependent claims.

BRIEF DESCRIPTION OF THE DRAWINGS

Other advantages of the invention will become apparent in the following detailed description, to be read while referring to the attached drawing comprising the figures where.

DESCRIPTION OF THE PREFERRED EMBODIMENTS

In certain figures among those mentioned above, and described in detail herein-below, certain superimposed parts are represented as if they were transparent, which was done for a better understanding of their interactions.

Figure 1:
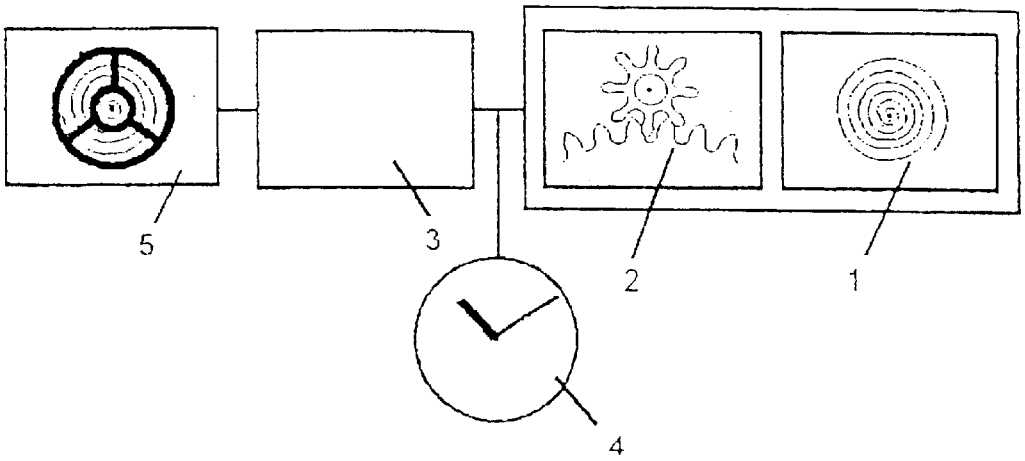
FIG. 1 presents a functional diagram of a mechanical watch.

FIG. 1 presents a functional diagram of a mechanical watch in which the mechanical energy that comes from a winding device, which is manual or automatic, is stored in a mainspring 1 so as to be distributed via a set of gears 2 to an escapement device 3 and to a display 4.

The escapement device 3 has the purpose, on one hand to deliver the power required to sustain the oscillations of oscillator 5, which in a general manner comprises a helical spring and an inertial mass, and on the other hand, to transmit the frequency given off by this oscillator to gears 2 in order to synchronize the time display with this frequency.

A good escapement device should not only have a good transmission efficiency between the power source and the oscillator but should also preserve the isochronism of the oscillator. To this end the inertias associated with the escapement device should be minimized and the power transfer between the escapement device and the oscillator should occur within a very short time while the velocity of the oscillator is largest.

Figure 2:
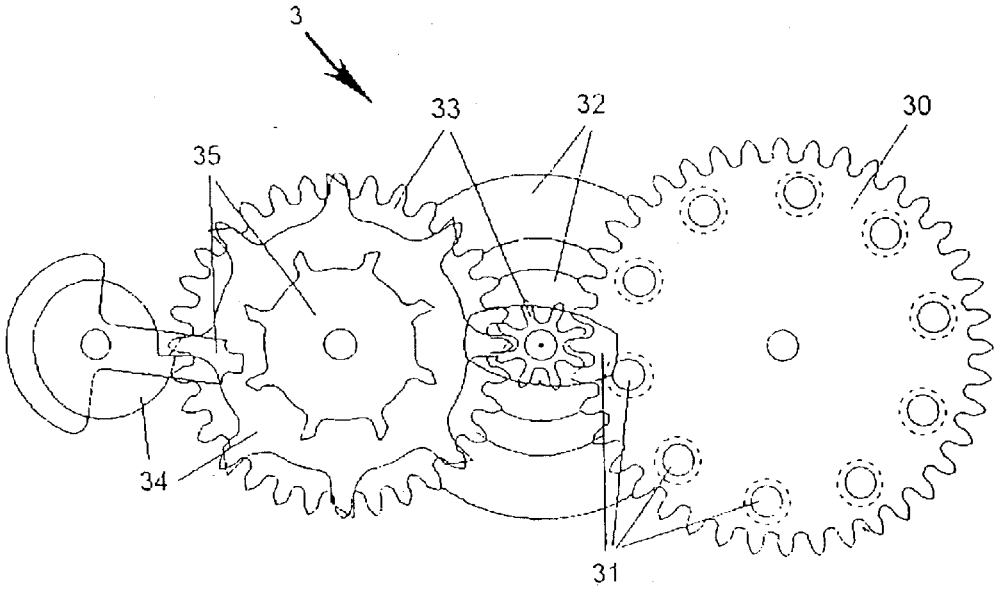
FIG. 2 presents a first embodiment of an escapement device according to the invention.

FIG. 2 shows a first embodiment of an escapement device 3 according to the invention, comprising: a transmission wheel 30 driven by the set of gears 2 seen above, blocking means 31, means for the generation of a magnetic torque 32, intermediate means of power transmission 33, unblocking means 34, and power transmission means 35. These different means will be described in greater detail hereinbelow.

Figure 3:
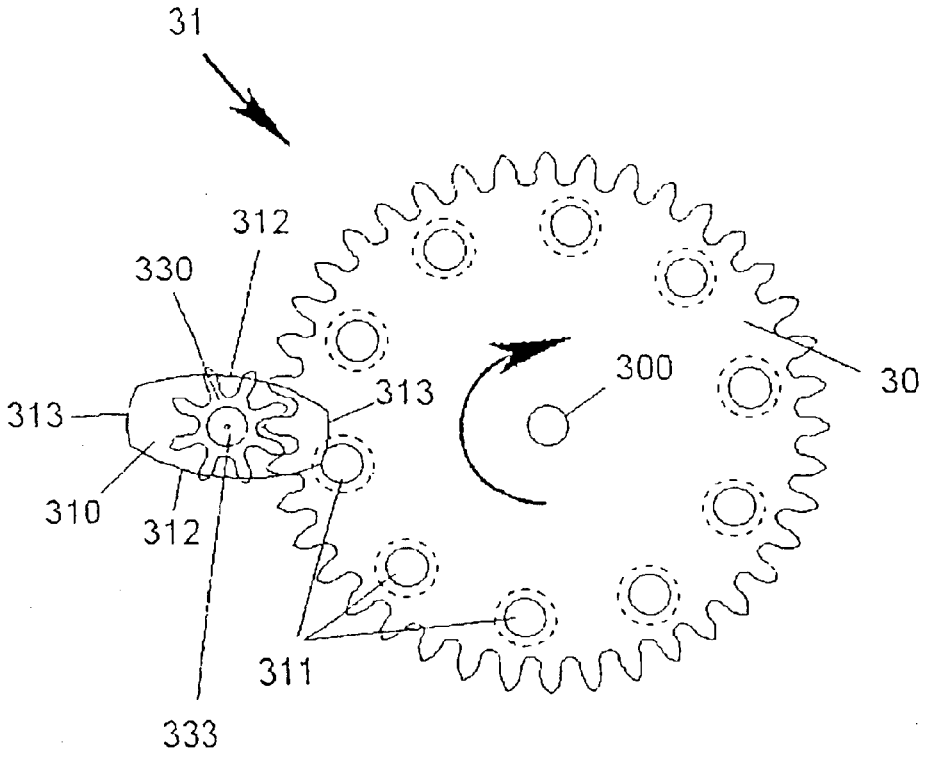
FIG. 3 presents particulars of a blocking device in the escapement device of the preceding figure.

FIG. 3 shows the transmission wheel 30 as well as the blocking means 31. The transmission wheel 30 is set in rotation by the mainspring 1 via the gears 2, and is driven by a mechanical torque of essentially constant value. The shaft 300 holding the transmission wheel 30 transmits the forward movement to the display device 4. The blocking means 31 consist here of a shaped part or cam 310 mounted on the same shaft 333 as a pinion 330 that is part of the intermediate means of transmission shown in greater detail in FIG. 7, as well as of bolts 311 fastened to the transmission wheel 30 so as to protrude perpendicularly to the plane of said transmission wheel. The bolts 311 are regularly distributed over a perimeter of said transmission wheel. In the example of an embodiment presented, the transmission wheel 30 has ten bolts 311, but depending on the requirements it could have a different number of bolts.

The shape and dimensions of the cam 310 as well as the diameter of the bolts 311 and of the perimeter along which they are inserted, are determined in such a way that, when the cam 310 which rotates together with the pinion 330 that is driven by the transmission wheel 30, is turned with one or the other of its long sides 312 to the transmission wheel 30, the transmission of torque can occur directly from the wheel 30 to the pinion 330. To the contrary, when one of the short sides 313 arrives in front of a bolt 311, blocking of this short side 313 of cam 310 on the bolt 311 occurs and the transmitted torque is interrupted.

Figure 4:
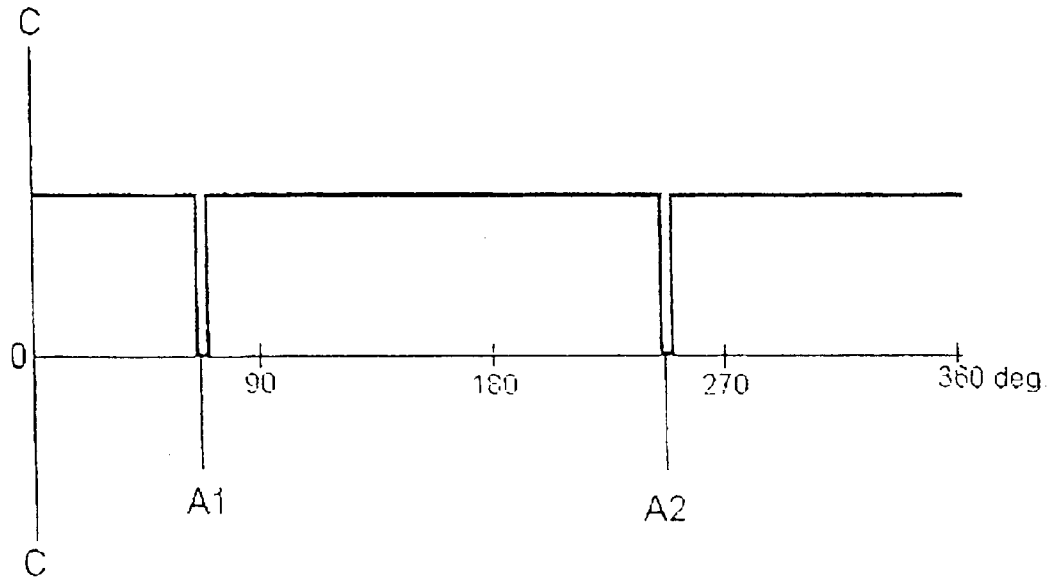
FIG. 4 presents a graph of the mechanical torque transmitted.

FIG. 4 shows the mechanical torque transmitted to the shaft 333 that holds the pinion 330, plotted as a function of the angle of rotation of said pinion. At first the curve shows a torque of constant value until the cam 310 arrives in the blocking position marked $A_l$ in the figure, where the transmitted torque becomes zero. Means of unblocking which will be described below then allow the device to become unblocked so that once again the torque of constant value can be transmitted until the next blocking occurs, marked at $A_2$, and so forth.

The blocking means 31 here described give rise to two blocking positions, $A_1$ and $A_2$, per turn of the pinion 330, but they could just as well be conceived so as to give rise to a different number of blocking positions.

Figure 5:
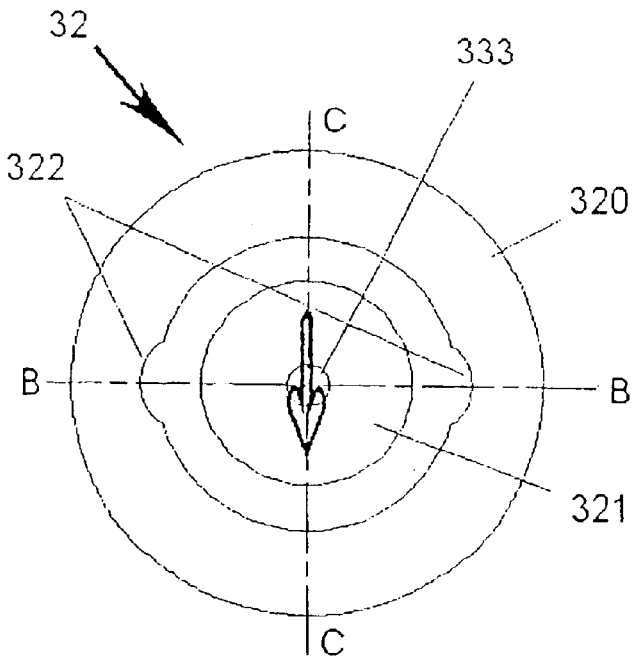
FIG. 5 presents a first embodiment of means to produce a variable torque.

FIG. 5 shows a preferential embodiment of means allowing a torque to be obtained that varies as a function of the angle of rotation of pinion 330. In this embodiment these means 32 are of a magnetic type, comprising a stator 320 and a rotor 321 that is arranged inside of said stator. The stator 320 consists of a ring of soft ferromagnetic material having along its inner perimeter two cavities 322 that are diametrically opposite to each other. The rotor 321 consists of a permanent magnet of cylindrical shape having a diametrical magnetization represented by the arrow in the drawing. The rotor 321 is mounted on the same shaft 333 as the pinion 330 and the cam 310 that have been described previously.

Figure 6:
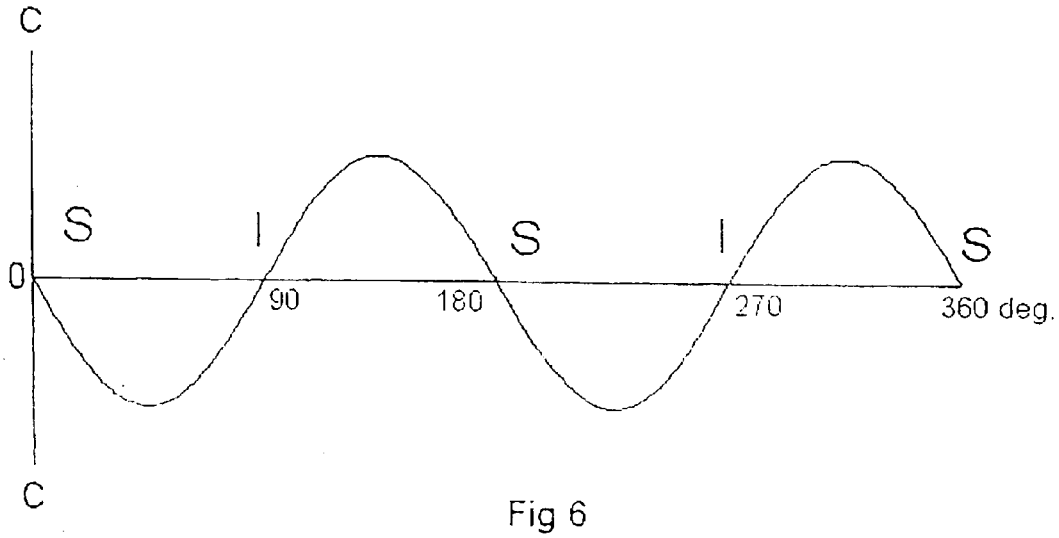
FIG. 6 presents a graph of the magnetic torque transmitted.

When the rotor 321 is set in rotation, the cavities 322 give rise to a magnetic torque acting on said rotor that is an essentially sinusoidal function, as can be seen in FIG. 6. When the rotor 321 is oriented so that its axis of magnetization is parallel to the axis C—C in FIG. 5 or perpendicular to the axis B—B containing the two cavities 322, then the rotor 321 is in a stable equilibrium position, in which a slight angular displacement will tend to return the rotor toward this stable position, but when the same rotor is oriented so that its axis of magnetization is parallel to the axis B—B, it is in an unstable equilibrium position, which means that a slight angular displacement will tend to remove the rotor even further from this unstable position. The stable angular positions are marked S in the curve of FIG. 6, they correspond to a zero crossing of the curve with a negative slope of the torque, while the unstable angular positions are marked 1 in the same curve, and correspond to a zero crossing of the curve with a positive slope of the torque.

It should be noted here that the frequency of the curve representing the torque is twice that of rotation of the magnet or of pinion 330, which is so because of the stator/rotor configuration described. With another configuration one could have a multiple other than two between these two frequencies.

Figure 7:
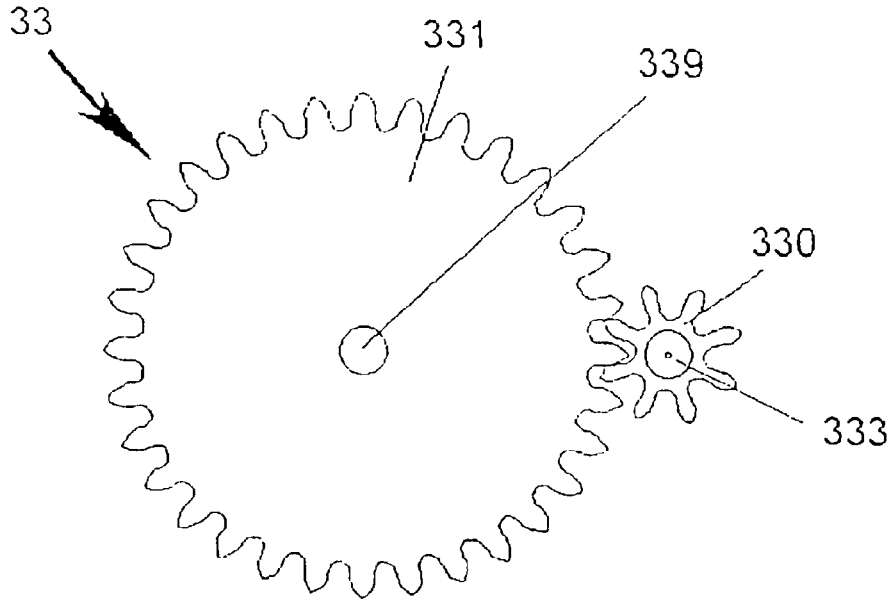
FIG. 7 presents intermediate transmission means.

The intermediate means of transmission 33 presented in FIG. 7 essentially comprise the pinion 330 already seen above, as well as a second transmission wheel 331 mounted on a shaft 339. We recall that the shaft 333 holding the pinion 330 also holds the cam 310 as well as the rotor 321. The intermediate means of transmission 33 allow the different torques coming into play in the device to be combined.

Figure 8:
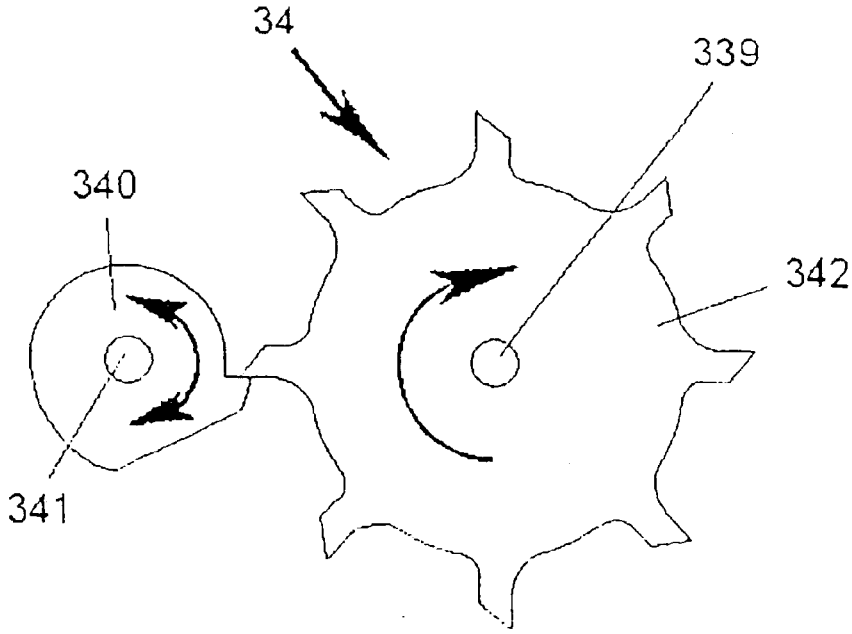
FIG. 8 presents the means of release.

The release means 34 of FIG. 8 are of known construction. The release pallet 340 is integral with the oscillator (that is not presented in the figure), and oscillates about the shaft 341. During its oscillatory motion in the counterclockwise direction, the tooth of pallet 340 encounters a tooth of the escapement wheel 342, and imparts to it an impulse of torque in the clockwise direction. As the escapement wheel 342 is mounted on the same shaft 339 as the second transmission wheel 331 seen above, this impulse of torque is therefore transmitted from this transmission wheel 331 to the pinion 330. By appropriate fixation of the escapement wheel 342 on the transmission wheel 331, viz., in such a way that the impulse of torque be transmitted just after blocking of the pinion 330 by the blocking device described previously, the impulse of torque in a counterclockwise direction that is transmitted to the pinion 330 will release the cam 310 from its blocking position on the bolt 311, allowing the transmission wheel 30 to perform part of a revolution until the next blocking occurs. The time display 4 has thus advanced by a time segment corresponding to one movement of pallet 340.

Figure 9:
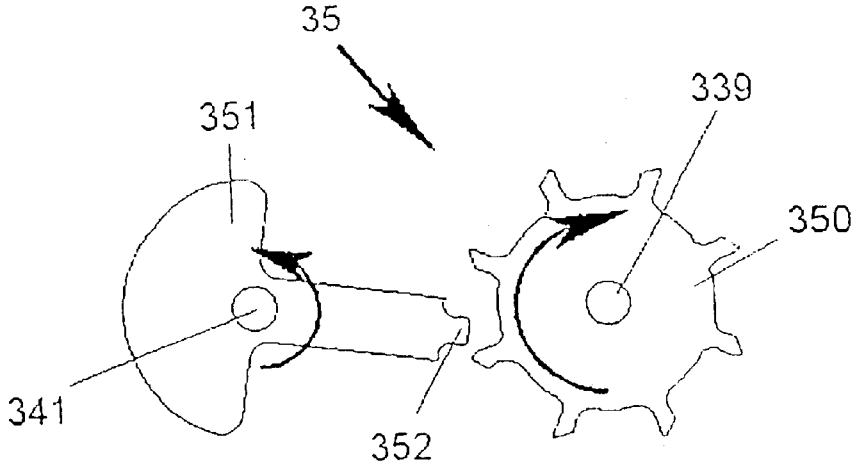
FIG. 9 presents the means of power transmission.

FIG. 9 shows means 35 of power transmission to the oscillator which are of classical design, consisting of a transmission wheel 350 fixed on the same shaft 339 as the wheel 331 and the escapement wheel 342, and of a shaped part 351 that is mounted on the shaft 341 seen above and attached to the balance wheel of the hairspring (not shown). When the wheel 350 turns clockwise as indicated, and one of its teeth encounters the short side 352 of the shaped part 351 that is moving more slowly counterclockwise, the wheel 350 will furnish kinetic energy to the part 351 or to the hairspring, thus allowing the oscillatory motion of the oscillator to be sustained.

As indicated, the release means 34 and the means 35 of power transmission are of known design, and are here described as examples for a realization; other devices performing the same functions may thus be foreseen as a replacement.

Figure 10:
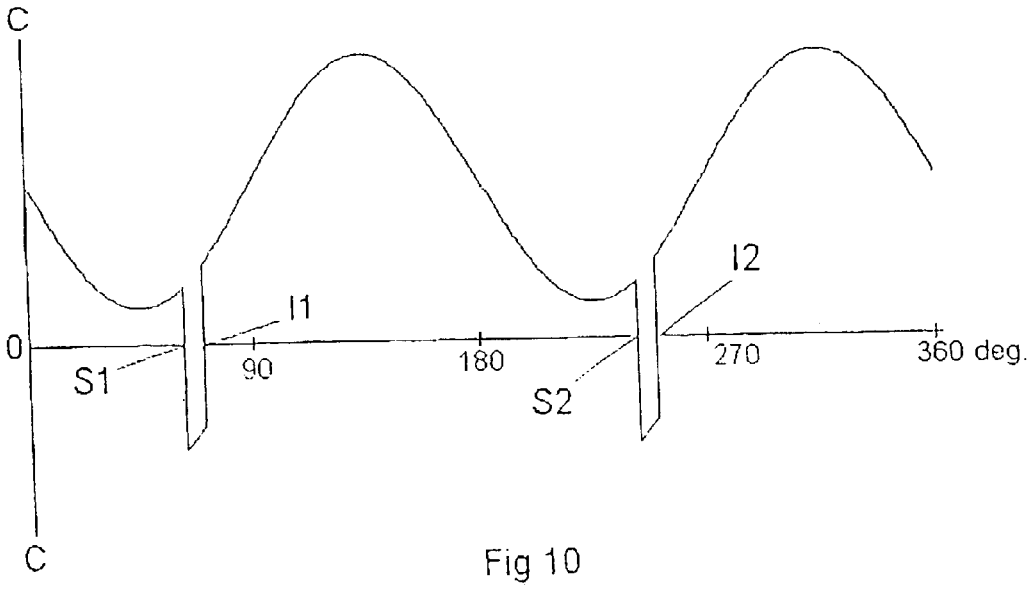
FIG. 10 presents a graph of the resulting torque.

The resulting torque on pinion 330 which consists of the essentially constant torque transmitted by the wheel 30 and shown in FIG. 4, and of the variable torque transmitted by the magnetic stator/rotor group and shown in FIG. 6, is shown in FIG. 10.

In the example shown for this first embodiment of an escapement device, this torque comprises two stable positions per turn of the pinion 330 which are marked $S_1$ and $S_2$ in the figure, and correspond to the two blocking positions in FIG. 4. These two stable positions $S_1$ and $S_2$ are defined as previously by a zero crossing of the curve of torque with negative slope. The torque also comprises two unstable positions per turn of the pinion 330 which are marked $I_1$ and $I_2$ and correspond to the two unblocking positions in FIG. 4. These two unstable positions $I_1$ and $I_2$ are defined as previously by a zero crossing of the curve of torque with positive slope.

One notices that the resulting torque is always positive, except in the blocking positions where it is negative.

Figure 11:
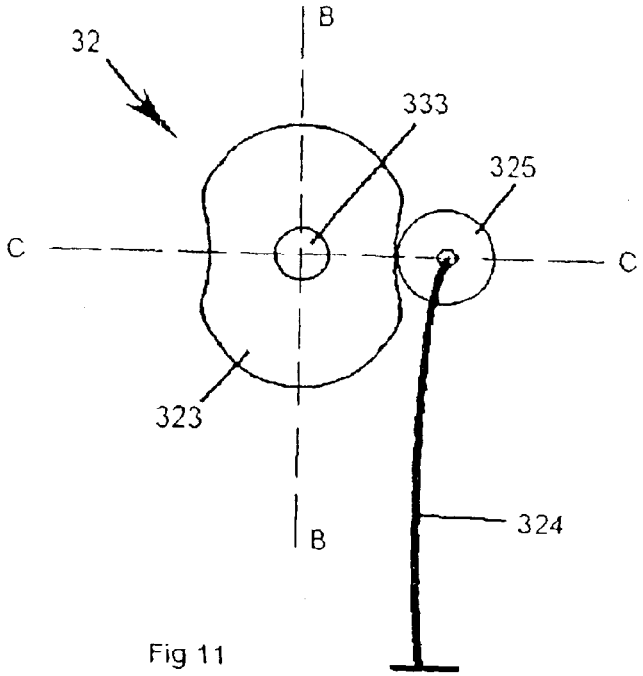
FIG. 11 presents a second embodiment of the means to produce a variable torque.

In FIG. 11 a second way is shown of how to obtain a variable mechanical torque having two stable points and two unstable points per turn of the wheel. A cam 323 is fixed on the same shaft 333 as the pinion 330 seen above; this cam has two concave portions and two convex portions. A spring lever 324 pivoting around one of its ends rests via a small wheel 325 on the periphery of cam 323. The resulting torque of this device is a variable function with two stable points while the small wheel 325 is aligned with the axis C—C, and two unstable points while it is aligned with the axis B—B.

It can thus be seen that several possibilities exist to obtain a variable mechanical torque having at least one stable point and one unstable point.

FIG. 10 shows the mechanical torque acting on the shaft 333 of pinion 330 in the absence of contact with the oscillator, plotted as a function of the angle of rotation of said pinion, now one can describe in parallel the functioning of the device as a function of time.

After a first rotation the device arrives in a blocking position as described with reference to FIG. 3, and corresponding to the point $S_1$ in FIG. 10. The device remains in this position for a time $T_1$.

When the pinion 330 receives the unblocking impulse, as described with reference to FIG. 8, it changes from position $S_1$ to position $I_2$ in FIG. 10, the transition being accomplished within a very short time called $T_2$ and being less than one thousandth of a second. This time must be as short as possible in order to cause minimum perturbation of the oscillator.

Starting with this position the resulting torque, which becomes positive, furnishes to the oscillator via the power transmission means described the energy that is required by the oscillator during a time $T_3$ which is of the order of a few thousandths of a second, lasting until the next blocking position $S_2$ is attained.

A mechanical oscillator generally has an oscillation frequency of a few hertz, typically 4 Hz. For this frequency the period T that corresponds to the sum $T_1+T_2+T_3$ is 250 ms. In view of the low values reported above for $T_2$ and $T_3$, the value of $T_1$ will then be just a few milliseconds smaller than that of T. It follows that the device is in a blocking position during the largest part of time T.

While a timepiece equipped with an escapement device such as that described above would satisfy the requirements indicated, such an escapement device when built into a wristwatch could be subject to a galloping effect.

In fact, in a wrist watch not subject to perturbations from outside, the amplitude of balance wheel oscillation in the clockwise direction is of the order of +240° relative to the axis that passes through the centers of rotation, and of the order of −240° in the opposite direction. Under these conditions the escapement wheel 30 advances one step in the clockwise direction in each balance wheel oscillation.

During an impact having a component in the plane of rotation of the escapement device, additional energy is transmitted to the oscillator via the inertia of the balance wheel, the result being that the amplitude of oscillation of the balance wheel may increase to a value higher than 360°. Under these conditions the unblocking means 34 in an escapement device such as that presented in FIG. 2 provide more than one impulse per oscillation period, which provokes a fast advance of the watch here called galloping.

Figure 12:
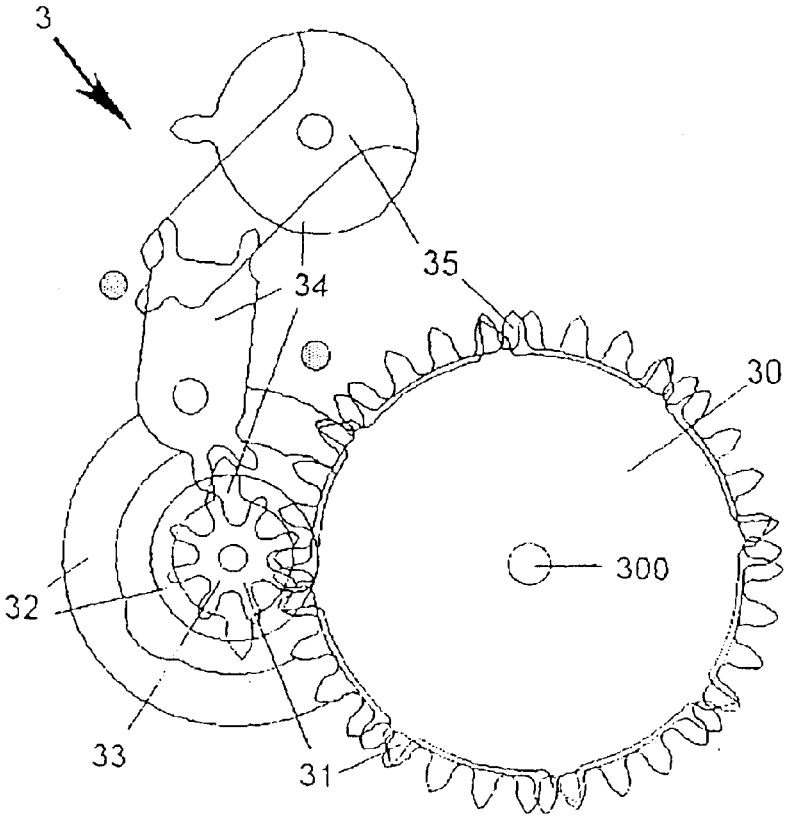
FIG. 12 presents a second embodiment of an escapement device according to the invention.

FIG. 12 presents another embodiment of an escapement device 3 according to the invention with which the drawback mentioned above can be avoided. This embodiment of the escapement device comprises as previously a transmission wheel 30 driven by the set of gears 2 (cf. FIG. 1), blocking means 31, means for the generation of a magnetic torque 32, intermediate transmission means 33, unblocking means 34, and power transmission means 35, the description of these different means being given hereafter.

Figure 13:
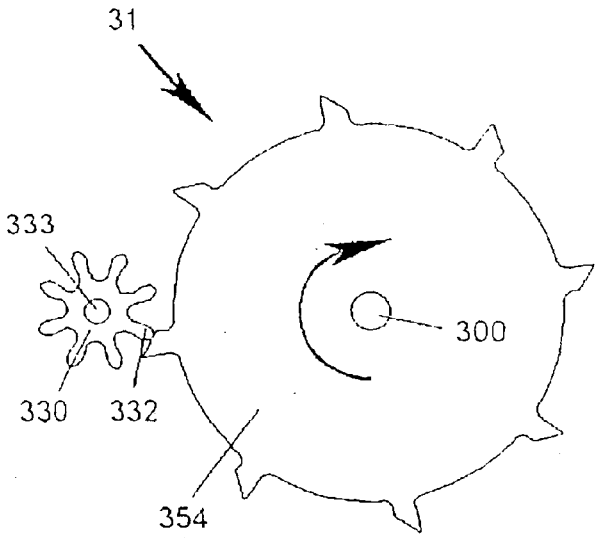
FIG. 13 presents particulars of the blocking device in the escapement device of FIG. 12.

The blocking means 31 of the escapement device of FIG. 12 can be seen in FIG. 13, they consist of a toothed wheel 354 that cooperates with the pinion 330. Here the teethed wheel 354 has eight teeth of asymmetric shape, is mounted on the same axle 300, and pivots together with the transmission wheel 30 seen above.

In the position called rest position shown in FIG. 13, the end of tooth 332 of the pinion 330 rests against the straight flank of an asymmetric tooth of the wheel 354.

When a torque is applied to the axis 300 of wheel 354 in the direction of the arrow, it exerts a force going through the center of rotation of shaft 333 of the pinion 330. For this reason no torque is transmitted to the pinion, and this set of wheel and pinion remains blocked, a situation which persists until unblocking occurs by the unblocking means described below.

Figure 14:
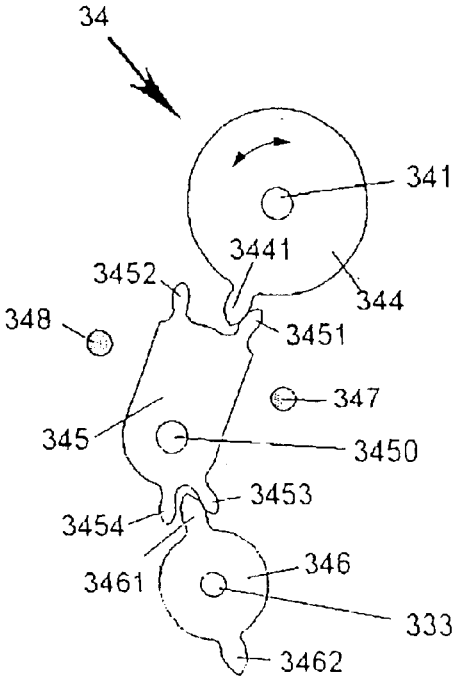
FIG. 14 presents the means of release in the escapement device of FIG. 12.

The unblocking means 34 of this embodiment can be seen in FIG. 14. The release pallet 344 is integrated into the oscillator (not shown in the figure) and oscillates about the shaft 341. During its oscillatory motion, the tooth 3441 of pallet 344 encounters either the tooth 3451 or the tooth 3452 of an intermediate part 345, depending on whether the pallet 344 turns counterclockwise or clockwise. The oscillatory motion of the intermediate part 345 about the axis 3450 is limited by bolts 347 and 348. The unblocking impulse coming from the balance wheel is transmitted to the pallet 346 that is mounted on the same axle 333 and pivots together with the pinion 330 seen above, which currently is blocked. This transmission of impulse actually occurs via the teeth 3454 and 3455 of the intermediate part 345 to one of the teeth, 3461 or 3462, of the pallet 346, and acts so as to unlock the set of wheel 300 and pinion 330 of FIG. 13, so that pinion 330 now can freely rotate.

Figure 15:
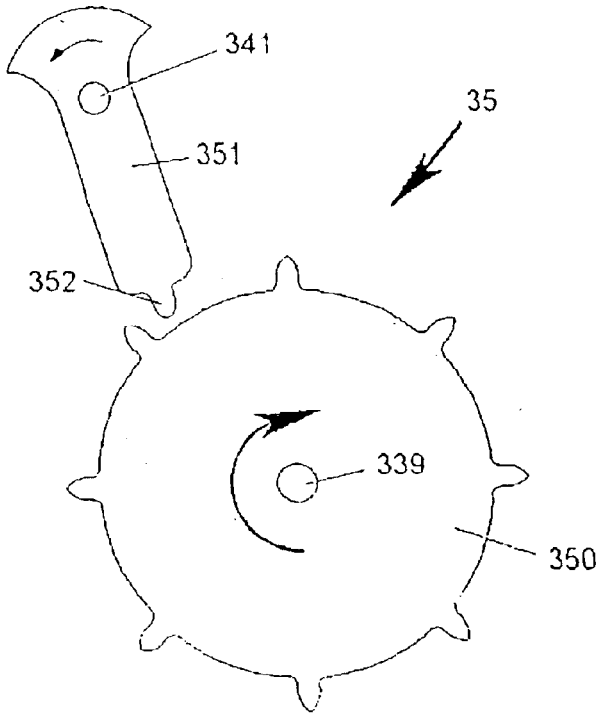
FIG. 15 presents the means of power transmission of the escapement device of FIG. 12.

FIG. 15 shows another embodiment of the power transmission means 35; these means function in a manner similar to those described with reference to FIG. 9.

The means for generation of a magnetic torque 32 that varies in time are similar to those described with reference to FIG. 5.

This embodiment of the escapement device according to FIG. 12 has the advantage over the embodiment of FIG. 2 that in the case of an impact, the amplitude of oscillation of the balance wheel can be limited by bolts 347 and 348, which thus prevent a loss of synchronization between the movement of the balance wheel and the movement of the wheel 30, and the gallop mentioned above.

Figure 16:
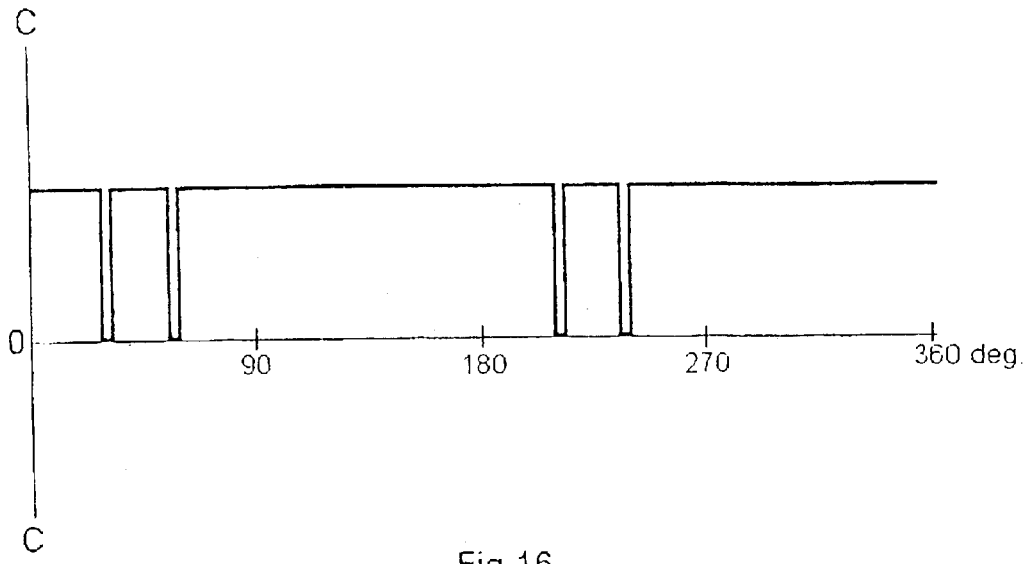
FIG. 16 presents another graph of the mechanical torque transmitted.
Figure 17:
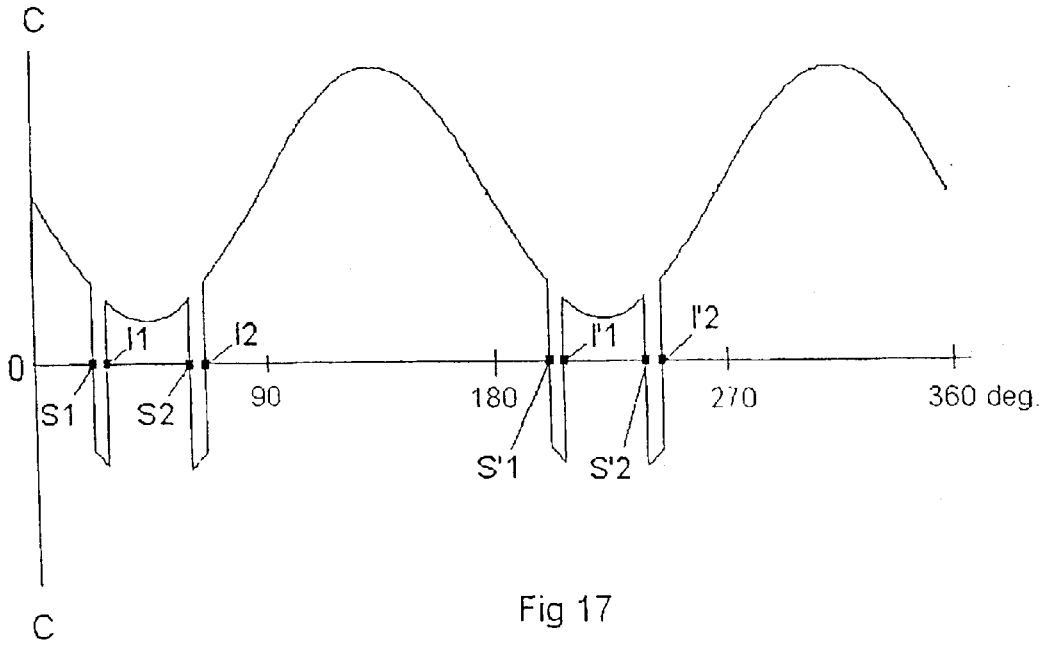
FIG. 17 presents another graph of the magnetic torque transmitted.

FIG. 16 shows another graph of the torque transmitted by an escapement device. As before, this torque is superimposed on that produced by the magnet in order to obtain the one shown in FIG. 17.

An escapement device intended to function according to these graphs comprises blocking means having two stable positions in each direction of the oscillatory motion, in other words, four stable positions per period, which is another way of avoiding the galloping mentioned above.

Other embodiments and variants than those described above can yet be envisaged, and more particularly, pinion 330 could be replaced by an anchor performing an oscillatory motion, the arms of the anchor fork bearing two opposing magnets.

Relative to the escapement devices of the prior art, an escapement device according to the invention and according to one or other of the embodiments described in addition offers several marked advantages:

- since the diameters of the rotating parts of the device according to the invention are smaller than those of corresponding parts in known devices, the inertia of said rotating parts is distinctly lower;

the power required for unblocking is lower; moreover, this unblocking is generally not attended by a recoil motion as in known anchor escapements;

thanks to the torque varying according to a curve, which is sinusoidal in the embodiments described, a maximum of torque is available just behind the unblocking position, which implies that the maximum power is transmitted immediately after unblocking, that is, over a limited angle of oscillation of the oscillator, at the moment when this oscillator has its highest velocity; in this way the isochronism of the oscillator is maximally preserved;

the transmission wheels have classical profiles with transmission efficiencies of the order of 90%;

Since certain transmissions of motion occur via gear wheels, greasing is not required as often as with traditional transmissions.

An escapement device as described according to one or the other of its embodiments is readily built into a timepiece, and particularly into a wristwatch, when considering the small diameter of the components of said device.

What is claimed is:

1. An escapement device notably for a timepiece, comprising a mobile organ of power transmission toward an oscillator able to receive said power and of transmitting an oscillation frequency, a first means able to produce at least a first portion of the power intended to supply the oscillator, said first means having a configuration such that it will supply a mechanical torque that is essentially variable as a function of the angle of angular displacement of said mobile organ, said mechanical torque having at least one stable position and at least one unstable position during one period of angular displacement of said mobile organ.

2. A device according to claim 1, including second means able to produce a second portion of the power intended to supply the oscillator, said second means having a configuration such that it will supply a mechanical torque that is essentially constant as a function of the angle of angular displacement of said mobile organ.

3. A device according to claim 2, including blocking means able to block the power transmission of said second means which are able to produce a second portion of the power intended to supply the oscillator.

4. A device according to claim 3, wherein the power transmitted to the oscillator by said mobile organ derives from the combination of said first means of power generation and of said second means of power generation, said power transmission being blocked during operation of said blocking means.

5. A device according to claim 4, wherein the mobile organ of power transmission is a rotating pinion that always transmits a positive mechanical torque, except for moments in time where the torque is between a stable position and an unstable position.

6. A device according to claim 5, wherein the torque transmitted by said pinion has two stable positions and two unstable positions per turn of said pinion.

7. A device according to claim 5, wherein the torque transmitted by said pinion has four stable positions and four unstable positions per turn of said pinion.

8. A device according to claim 5, wherein said first means able to generate at least a first portion of the power intended to supply the oscillator comprises a rotor bearing a magnet which rotates together with said pinion, said rotor being placed into a magnetic circuit.

9. A device according to claim 8, wherein the magnetic circuit consists of a stator surrounding said rotor, said stator exhibiting at least one asymmetry.

10. A device according to claim 5, wherein said first means able to generate at least a first portion of the power intended to supply the oscillator comprises a cam exhibiting at least one concave portion and one convex portion and rotating together with said pinion, a lever resting against the periphery of the cam while being pressed against said periphery by an elastic means.

11. A device according to claim 3, wherein the blocking means has a configuration such that it operates in stable equilibrium points of a curve of transmitted torque.

12. A device according to claim 11, wherein the blocking means has a configuration such that its operating point in the stable equilibrium points of the curve of transmitted torque is closer to the unstable equilibrium position of the mechanical torque furnished by said first means which are able to generate said first portion of the power intended to supply the oscillator, than to the stable position of the mechanical torque transmitted by the same first means.

13. A device according to claim 12, wherein the mobile organ is a rotating pinion that always transmits a positive mechanical torque except for moments in time where the torque is between a stable position and an unstable position, the blocking means comprises a cam having at least one peripheral blocking portion, said cam being fixed to said pinion of power transmission for the supply of said oscillator, and a transmission wheel equipped with protruding projections cooperating with said cam in order to block said escapement.

14. A device according to claim 12, wherein the blocking means comprises said pinion of power transmission for the supply of said oscillator and a toothed wheel exhibiting a number of asymmetric teeth cooperating with said pinion in order to block said escapement.

15. A device according to claim 13, including an unblocking device able to command resumption of the transmission of power intended to supply the oscillator, said unblocking device having a configuration such that it operates between a stable equilibrium point and an unstable equilibrium point of the curve of transmitted torque.

16. A device according to claim 15, wherein the unblocking device comprises a release pallet mounted on said oscillator, said release pallet being able to transmit an impulse of torque to an escapement wheel able to retransmit this impulse to said pinion, said impulse being able to unblock said cam blocked by one of said protruding projections.

17. A device according to claim 15, wherein the blocking means comprises said pinion of power transmission for the supply of said oscillator and a toothed wheel exhibiting a number of asymmetric teeth cooperating with said pinion in order to block said escapement, the unblocking device comprising a release pallet mounted on said oscillator, said release pallet being able to transmit an impulse of torque to an intermediate part mounted so as to pivot oscillating about an axis, said intermediate part being able to retransmit this impulse to another pallet mounted on said pinion which is able to unblock said pinion that is blocked against a tooth of the toothed wheel.

18. A device according to claim 17, wherein the amplitude of oscillating pivoting of the intermediate part is limited by two bolts.

19. A timepiece equipped with an escapement device according to claim 1.

* * * * *

UNITED STATES PATENT AND TRADEMARK OFFICE

CERTIFICATE OF CORRECTION

PATENT NO. : 6,712,500 B2
DATED : March 30, 2004
INVENTOR(S) : Xuan-Mai Tu et al.

It is certified that error appears in the above-identified patent and that said Letters Patent is hereby corrected as shown below:

Title page,
Item [56], References Cited, U.S. PATENT DOCUMENTS, insert:
-- 5,025,428 A 6/1991 Jarochowski --; and insert:
-- OTHER PUBLICATIONS
Echappements et Moteurspas a pas (Excapements and Step Motors), "Les Echappements", Federation des Ecoles Techniques de Suisse FET-Neuchatel"; Charles Huguenin et al.

Theorie d'horlogerie (Watch-Making theory), Federation des Ecoles, Charles-Andre Reymondin et al. --

Column 8,
Line 55, delete "oscillating" and insert -- oscillatingly --.

Signed and Sealed this

Seventh Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,712,500 B2
DATED : March 30, 2004
INVENTOR(S) : Xuan-Mai Tu et al.

It is certified that error appears in the above-identified patent and that said Letters Patent is hereby corrected as shown below:

Title page,
Item [56], References Cited, U.S. PATENT DOCUMENTS, insert:
-- 5,025,428 A 6/1991 Jarochowski --.
Insert -- OTHER PUBLICATIONS
Echappements et Moteurspas a pas (Excapements and Step Motors), "Les Echappements", Federation des Ecoles Techniques de Suisse FET-Neuchatel"; Charles Huguenin et al.

Theorie d'horlogerie (Watch-Making theory), Federation des Ecoles, Charles-Andre Reymondin et al. --

Column 8,
Line 55, delete "oscillating" and insert -- oscillatingly --.

Signed and Sealed this

Twenty-third Day of November, 2004

JON W. DUDAS
*Director of the United States Patent and Trademark Office*